US005515621A

United States Patent [19]

Bloom

[11] Patent Number: 5,515,621

[45] Date of Patent: May 14, 1996

[54] NAIL DRYING SYSTEM

[75] Inventor: Ira G. Bloom, Dallas, Tex.

[73] Assignee: ASR Affiliates, Inc., Addison, Tex.

[21] Appl. No.: 264,823

[22] Filed: Jun. 23, 1994

[51] Int. Cl.[6] ..... F26B 3/34

[52] U.S. Cl. ..... 34/275; 34/202; 34/426; 34/68

[58] Field of Search ..... 34/275–278, 202, 34/426, 60, 68; 250/494.1, 504 R

[56] References Cited

U.S. PATENT DOCUMENTS

| | | | |
|---|---|---|---|
| 2,262,274 | 11/1941 | Fingerlin | 34/202 |
| 4,731,541 | 3/1988 | Shoemaker | 250/504 R |
| 5,099,586 | 3/1992 | Anderson | 34/275 |
| 5,130,551 | 7/1992 | Nafziger et al. | 34/202 |
| 5,249,367 | 10/1993 | Nafziger et al. | 34/275 |

*Primary Examiner*—Denise L. Gromada

*Attorney, Agent, or Firm*—Gregory M. Howison; Joseph Shallenburger

[57] ABSTRACT

The present invention disclosed and claimed herein comprises an apparatus and method for curing and drying coatings on nails of the human hand. A housing (12) is provided having two elongated solid sides (14), one elongated solid top (15), two solid ends (16), and an elongated underneath side (18) having a length. Restrictive air vents (22) are provided along the length of the elongated underneath side (18) of the housing (12), such that the housing (12) and air vents (22) define a substantially closed air pressure chamber (34). An ultraviolet light source (20) is disposed along the underneath side (18). A flat surface (26) running the length of the underneath side (18) is disposed a distance beneath the restrictive air vents (22) and the ultraviolet light source (20). Also provided are air pressure means (28) for pressurizing the air pressure chamber (34), such that air flows evenly through the restrictive air vents (22) and evenly aerates the area above the flat surface (26) along the full length of the underneath side (18).

15 Claims, 2 Drawing Sheets

NAIL DRYING SYSTEM

TECHNICAL FIELD OF THE INVENTION

The present invention pertains in general to a nail drying apparatus and method, and in particular, to drying nails using moving air and ultraviolet light.

BACKGROUND OF THE INVENTION

In the past, nail polish and enamels were usually air dried after they were applied in an effort to speed up the very slow drying process. Even this air drying process required a very long period of time before the nail polish dried on the nail. While waiting for the polish to dry, the polish wearer had to be extremely careful to avoid touching the surface of the nails, or else the polish would smear or smudge, resulting in a ruined manicure. In effect, the nail polish user or wearer was prevented from using their hands in any normal, everyday activity while the polish was drying. This especially proved burdensome for beauty salon customers who needed to manipulate or handle purses, car keys, and other objects immediately after receiving a manicure.

Various devices have been developed to try to expedite the drying process. These devices generally consisted of a box-type dryer which blew or circulated hot or cold air onto the wet surface of each of the nails for a specified period of time. However, this device, if successful, could only dry the top nail polish protection coating on each nail and did not dry the nail polish located underneath the top coating. Also, blowing a stream of air directly on a nail covered with wet nail polish would sometimes cause the polish to ripple from the direct air pressure. Consequently, additional exposure for an extended period of time to the drying air was usually required to dry the lower coating or coating of nail polish and the manicure was still easily ruined if the nail surface came into contact with another hard surface or the drying air was moving too fast. As a result, nail polish users or wearers still had to use their hands cautiously for relatively long periods of time so as not to ruin the manicure.

SUMMARY OF THE INVENTION

The present invention disclosed and claimed herein comprises an apparatus and method for curing and drying coatings on nails of the human hand. A housing is provided having two elongated solid sides, an elongated top, two solid ends, and an elongated underneath side having a length. Restrictive air vents are provided along the length of the elongated underneath side of the housing, such that the housing and air vents define a substantially closed air pressure chamber. An ultraviolet light source is disposed along the underneath side of the housing with the ultraviolet light source disposed such that it does not block the flow of air through the vent. A flat surface running the length of the underneath side is disposed a distance beneath the restrictive air vents and the ultraviolet light source. Also provided is an air pressure means for pressurizing the air pressure chamber, such that air flows evenly through the restrictive air vents and evenly aerates the area above the flat surface along the full length of the elongated underneath side.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
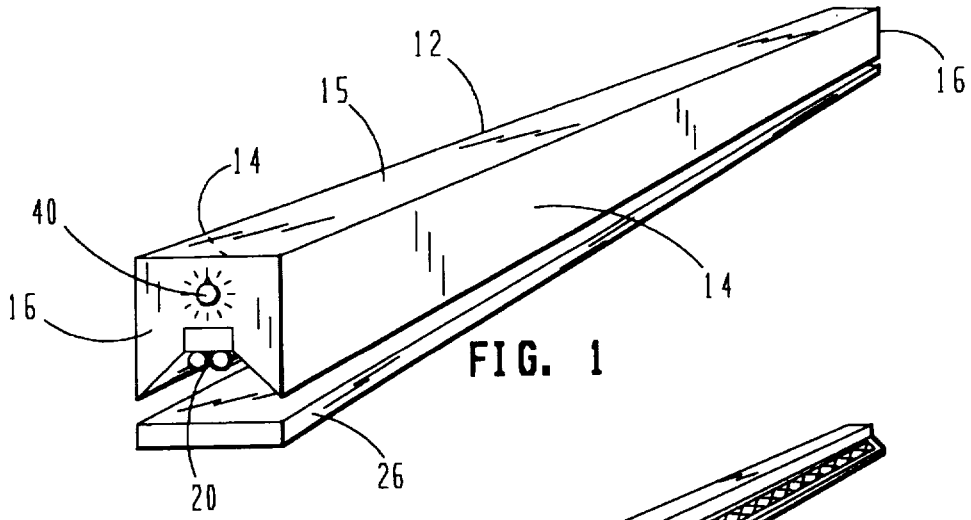
FIG. 1 illustrates a perspective view of the system of the present invention.

Referring now to FIG. 1, there is illustrated a perspective view of the system of the present invention. A housing 12 is provided having two solid sides 14, one solid top 15, and two solid ends 16. The two solid sides 14, the solid top 15, and the two solid ends 16 are made of a material that is resistant to the penetration of ultraviolet radiation. A flat surface 26 is provided underneath and spaced a distance from the housing 12. The flat surface 26 is the same width and length as the housing 12. Also provided is an underneath side (not shown). The three solid sides 14, the two solid ends 16 and the underneath side (not shown) form an air pressure chamber (not shown). An ultraviolet light source 20 is provided and is disposed such that it runs the full length of the housing 12. A timer 40 is provided and is operable to switch the ultraviolet light source 20 on and off.

Figure 2:
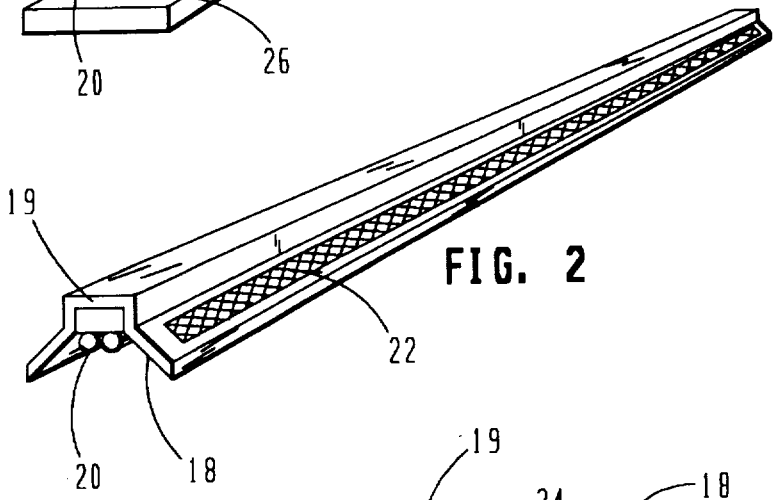
FIG. 2 illustrates a perspective view of the system of the present invention with the solid sides and ends removed.

Referring now to FIG. 2, there is illustrated a perspective view of the system of the present invention with the two solid sides 14, solid top 15, and the two solid ends 16 removed. There is provided an elongated underneath side 18 with first and second elongated surfaces extending upward and inward from the solid sides 14. Along the center of the underneath side 18, a recess 19 is provided which runs the full length of the underneath side 18. Disposed along the full length of the elongated underneath side 18 and on each side of the recess 19 are restrictive air vents 22. Disposed along the full length of the underneath side 18 inside the recess 19 is an ultraviolet light source 20. The ultraviolet light source is provided between the restrictive air vents 22 and inside the recess 19 such that the ultraviolet light source 20 will not block air flowing from the restrictive air vents 22. The restrictive air vents 22 are formed such that they form less than a 90° angle with the horizontal, and such that they are both facing the center of the width of the flat surface 26.

Figure 3:
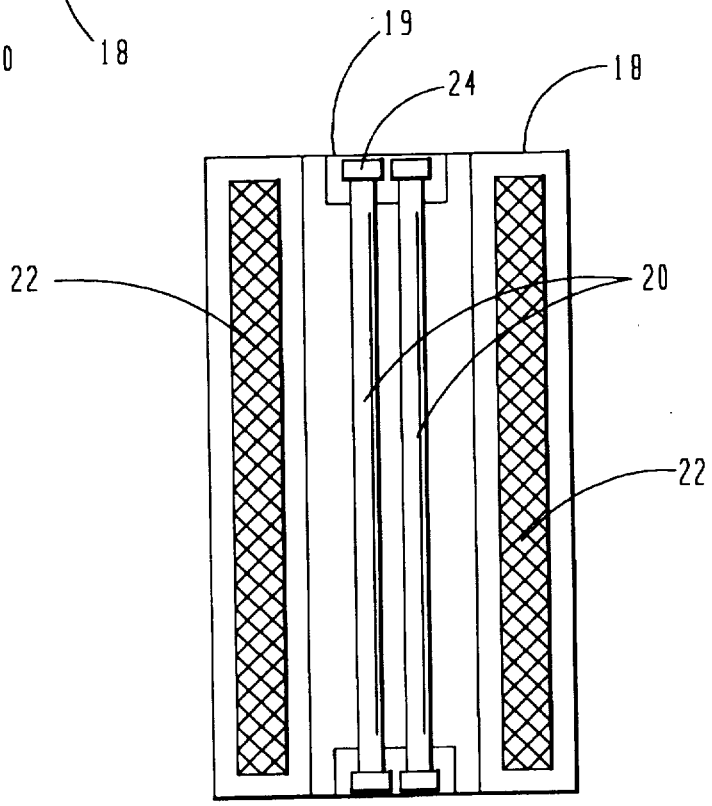
FIG. 3 illustrates a view of the underneath side of the housing of the system of the present invention.

Referring now to FIG. 3, there is illustrated a view of the bottom of the underneath side 18. The two restrictive air vents 22 are illustrated running the full length of the underneath side 18. A ultraviolet light socket 24 is disposed in the recess 19 at the center of each end of the underneath side 18. Ultraviolet light bulbs 20 are disposed in the ultraviolet light socket 24 such that the ultraviolet light bulbs are positioned in the center of the underneath side 18 and inside the recess 19 and run the full length of the underneath side 18. The restrictive air vents 22 are disposed on each side of the underneath side 18 and run the full length of the underneath side 18 on each side of the recess 19. The restrictive air vents 22 are spaced apart from each other to allow room for the ultraviolet light bulbs 20.

Figure 4:
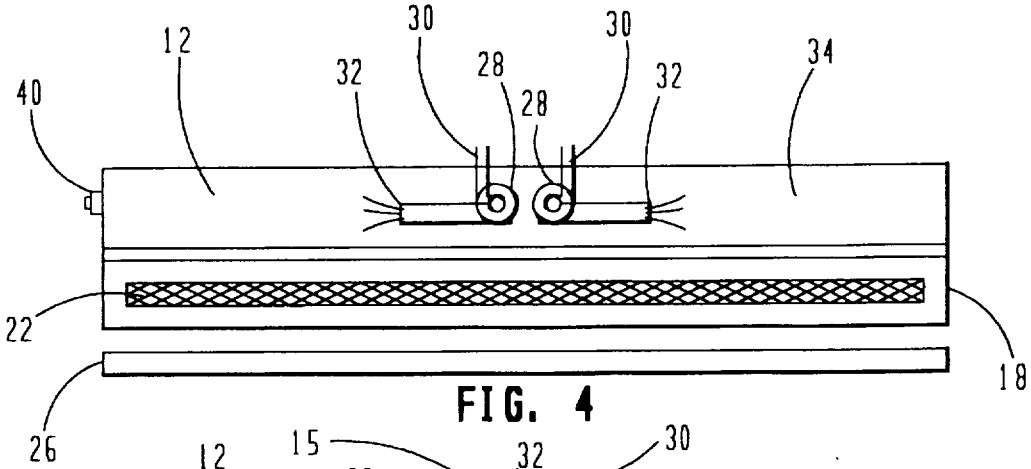
FIG. 4 illustrates a lengthwise cross-sectional view of the system of the present invention.

Referring now to FIG. 4, there is illustrated a cross-sectional view of the system of the present invention. The housing 12 is illustrated. A flat surface 26 is provided a small distance below the underneath side 18 and running the full length of the underneath side 18. Two fans 28 are provided inside the air pressure chamber 34. Each fan 28 has an air intake 30 which extends outside the air pressure chamber 34 and an air outlet 32 which is inside the air pressure chamber 34. The fans 28 are mounted to one of the solid sides 14 or the solid top 15 of the housing 12. The fans 28 are located near the center of the length of the housing 12 and underneath side 18. The fans 28 expel air in opposite directions along the length of the underneath side 18 and substantially parallel to the restrictive air vents 22. The fans 28 are also controlled by the timer 40.

Figure 5:
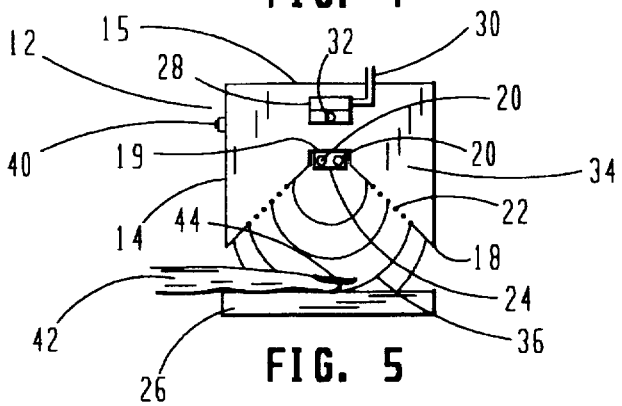
FIG. 5 illustrates a cross-wise cross-sectional view of the system of the present invention.

Referring now to FIG. 5, there is illustrated a side cross-sectional view of the system of the present invention. The housing 12 having two sides 14 and a top 15 is illustrated. The underneath side 18 is illustrated having disposed therein restrictive air vents 22. The recess 19 is provided running the length of the underneath side 18. The fan 28 is disposed inside the air pressure chamber 34 having an air intake 30 and an air outlet 32. The fan 28 is positioned so that the air outlet 32 points toward the solid end of the housing (not shown), so that the air from the air outlet 32 is expelled parallel to the restrictive air vents 22. Ultraviolet light fixtures 24 and ultraviolet light bulbs 20 are illustrated. Also illustrated is the flat surface 26 disposed a small distance below the underneath side 18.

In operation, a person sets the timer 40 to the desired length of time. This turns on the fans 28 and the ultraviolet lights 20. Then, one or more persons place their hand 42 containing fingernails 44 on the flat surface 26. The ultraviolet lights 20 shine directly on the fingernails 44. The fan 28 takes air in through the air intake 30 and expels it through the air output 32. The air is expelled laterally, i.e., parallel to the length of the underneath side 18. This creates a back pressure in the air pressure chamber 34. The air pressure chamber 34 is long and enclosed by two solid sides 14, one solid top 15, two solid ends 16, and the underneath side 18 containing the restrictive air vents 22. Because of this, air does not flow directly from the air output 32 of the fan 28 through the restrictive air vents 22, but the air from the air output 32 of the fan 28 builds up as back pressure in the air pressure chamber 34. When the back pressure in the air pressure chamber 34 reaches a certain point, a gentle flow of air is pushed through the restrictive air vents 22 such that a pillow of air 36 is created just above the flat surface 26. This is due to the fact that the air flow through the vents 22 is restricted to ensure that the pressure is relatively even over the entire length of the air pressure chamber 34. This gentle pillow of air 36 coming from the restrictive air vents 22 in addition to the ultraviolet light helps to harden and dry the coatings on the nails 44 without disturbing or rippling the coating on the nails 44. It is noted that the chamber 34 is substantially longer than a human hand, such that up to ten individuals can dry their nails at the same time by distributing the individuals on either side of the chamber 34.

Figure 6:
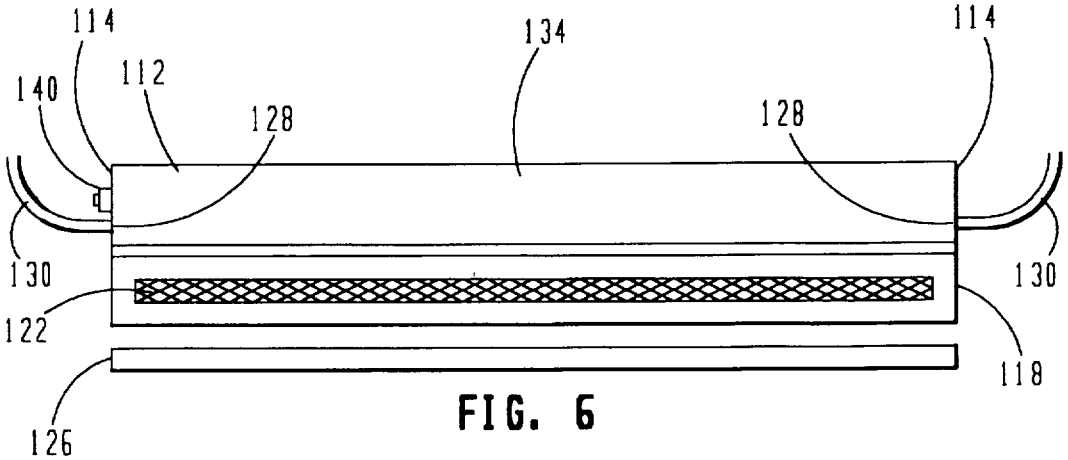
FIG. 6 illustrates a lengthwise cross-sectional view of an alternate embodiment of the system of the present invention.

Referring now to FIG. 6, there is illustrated a cross-sectional view of an alternate embodiment of the system of the present invention. A housing 112 is illustrated substantially similar to housing 12 above. A flat surface 126 is provided a small distance below the underneath side 118 and running the full length of the underneath side 118. Two air inlets 128 are provided inside the air pressure chamber 134. Each air inlet 128 has an air hose 130 which extends outside the air pressure chamber 134 and is attached to an air compressor (not shown). The air inlets 128 are disposed in each of the solid ends 114 of the housing 112. The air inlets 128 expel air in opposite directions along the length of the underneath side 118 and parallel to the restrictive air vents 122. The air compressor (not shown) is also controlled by the timer 140.

Figure 7:
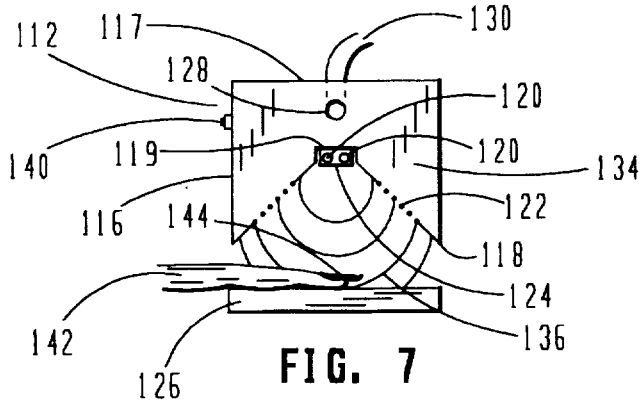
FIG. 7 illustrates a cross-wise cross-sectional view of an alternate embodiment of the system of the present invention.

Referring now to FIG. 7, there is illustrated a side cross-sectional view of the alternate embodiment of the system of the present invention. The housing 112 having two sides 116 and a top 117 is illustrated. An underneath side 118 is illustrated having disposed in it restrictive air vents 122. A recess 119 is provided running the length of the underneath side 118. The air inlet 128 is disposed inside of the air pressure chamber 134 having an air hose 130. The air inlet 128 is positioned in the middle of the solid end of the housing (not shown), so that the air from the air inlet 128 is expelled parallel to the restrictive air vents 122. Ultraviolet light fixtures 124 and ultraviolet light bulbs 120 are also illustrated. Also illustrated is a flat surface 126 disposed a small distance below the underneath side 118.

In operation, a person sets the timer 140 to the desired time. This turns on the air compressor (not shown) and the ultraviolet lights 120. Then, one or more persons place their hand 142 containing fingernails 144 on the flat surface 126. The ultraviolet lights 120 shine directly on the fingernails 144. The air inlet 128 expels air into the air pressure chamber 134. The air is expelled laterally, i.e., parallel to the length of the underneath side 118. This creates a back pressure in the air pressure chamber 134. The air pressure chamber 134 is long and enclosed by two solid sides 116, one solid top 117, two solid ends 114, and the underneath side 118 containing the restrictive air vents 122. Because of this, air does not flow directly from the air inlet 128 through the restrictive air vents 122, but the air from the air inlet 128 builds up as back pressure in the air pressure chamber 134. When the back pressure in the air pressure chamber 134 reaches a certain point, a gentle flow of air is pushed through the restrictive air vents 122 such that a pillow of air 136 is created just above the flat surface 126. This is due to the fact that the air flow through the air vents 122 is restricted to ensure that the pressure is relatively even over the entire length of the air pressure chamber 134. This gentle pillow of air 136 coming from the restrictive air vents 122 helps to harden and dry the coatings on the nails 144 without disturbing or rippling the coating on the nails 144. It is noted that the chamber 134 is substantially longer than a human hand, such that up to ten individuals can dry their nails at the same time by distributing the individuals on either side of the chamber 134.

In summary, there has been provided an apparatus and method for curing and drying coatings on nails of the human hand. A housing is provided having two elongated solid sides, one elongated solid top, two solid ends, and an elongated underneath side having a length. Restrictive air vents are provided along the length of the elongated underneath side of the housing, such that the housing and air vents define a substantially closed air pressure chamber. An ultraviolet light source is disposed along the underneath side of the housing with the ultraviolet light source disposed such that it does not block the flow of air through the vent. A flat surface running the length of the underneath side is disposed a distance beneath the restrictive air vents and the ultraviolet light source. Also provided is an air pressure device for pressurizing the air pressure chamber, such that air flows evenly through the restrictive air vents and evenly aerate the area above the flat surface along the full length of the elongated underneath side.

Although the preferred embodiment has been described in detail, it should be understood that various changes, substitutions and alterations can be made therein without departing from the spirit and scope of the invention as defined by the appended claims.

What is claimed is:

1. An apparatus for curing and drying coatings on nails of the human hand, comprising:

an elongated flat surface for allowing a plurality of users to place their hands thereon to allow the associated nails to dry when polish is applied thereto;

a housing having as an elongated solid top side, two elongated solid sides, two solid ends, and an elongated underneath side having a length and disposed above said surface, said elongated underneath side having first and second elongated surfaces extending upward and inward from said elongated solid sides;

restrictive air vents formed along said length of said first and second elongated surfaces of said elongated underneath side of said housing such that said housing and said air vents form a substantially enclosed air pressure chamber, wherein said restrictive air vents are disposed such that they form less than a 90 degree angle with the horizontal;

an ultraviolet light source disposed along said underneath side of said housing; and air pressure means for pressurizing said pressure chamber such that air flows evenly through said restrictive air vents and evenly aerates the area above said flat surface for the full said length of said elongated underneath side.

2. The apparatus of claim 1, wherein said housing is constructed of an ultraviolet light resistant material.

3. The apparatus of claim 1, wherein said ultraviolet light source is disposed such that it does not block the flow of air through said vents.

4. The apparatus of claim 1, wherein said air pressure means comprises fans for pulling air from the surrounding area into said air pressure chamber.

5. The apparatus of claim 4, wherein said fans comprise a first fan and a second fan, each having an inlet and an outlet, each of said first and second fans disposed within the substantial center of said air pressure chamber, the outlets of said first and second fans interfaced with the exterior of said air pressure chamber, the outlet of said first fan directed toward one end of said air pressure chamber substantially parallel with said surface and the outlet of said second fan directed toward the opposite end of said air pressure chamber and substantially parallel to said surface.

6. The apparatus of claim 1, wherein said air pressure means comprises an air compressor and means for transporting compressed air to said air pressure chamber.

7. The apparatus of claim 1, wherein said air pressure means and said air vents cause the aeration to be evenly dispersed under said air pressure chamber.

8. The apparatus of claim 1, and further comprising a timer for automatically turning on and off said ultraviolet light source and said aeration means.

9. A method for curing and drying coatings on nails on the human hand comprising the steps of:

applying a coating to the nails;

placing the hand containing the nails on a flat surface;

aerating the fingernails with moving air flowing out of an air pressure chamber through restrictive air vents along the underneath side of a housing which defines a substantially closed air pressure chamber, wherein the restrictive air vents are disposed such that they form a less than 90 degree angle with the horizontal; and exposing the nails to an ultraviolet light disposed at the base of the substantially closed air distribution chamber.

10. The method of claim 9, wherein the housing is constructed of an ultraviolet resistant material.

11. The method of claim 9, wherein the step of aerating comprises using a plurality of fans disposed in the air pressure chamber for pulling air from the surrounding area into the air pressure chamber.

12. The method of claim 11, wherein the fans comprise a first fan and a second fan, each having an inlet and an outlet, each of the first and second fans disposed within the substantial center of the air pressure chamber, the outlets of the first and second fans interfaced with the extension of the air pressure chamber, the outlet of the first fan directed toward one end of the air pressure chamber substantially parallel with the surface and the outlet of the second fan directed toward the opposite end of the air pressure chamber and substantially parallel to the surface.

13. The method of claim 9, wherein the step of aerating comprises using an air compressor and to transport compressed air from the air compressor into the air distribution chamber.

14. The method of claim 9, wherein the step of aerating comprises aerating with air evenly dispersed under the air pressure chamber.

15. The method of claim 9, and further comprising the step of timing and automatically turning on and off the ultraviolet light source.

* * * * *